US009644889B2

(12) United States Patent
Ransbarger et al.

(10) Patent No.: US 9,644,889 B2
(45) Date of Patent: May 9, 2017

(54) SYSTEM FOR INCONDENSABLE COMPONENT SEPARATION IN A LIQUEFIED NATURAL GAS FACILITY

(75) Inventors: Weldon L. Ransbarger, Houston, TX (US); Megan V. Evans, Houston, TX (US); Attilio J. Praderio, Humble, TX (US); David B. Messersmith, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 1393 days.

(21) Appl. No.: 12/554,539

(22) Filed: Sep. 4, 2009

(65) Prior Publication Data

US 2010/0058803 A1 Mar. 11, 2010

Related U.S. Application Data

(60) Provisional application No. 61/095,189, filed on Sep. 8, 2008.

(51) Int. Cl.
*F25J 1/00* (2006.01)
*F25J 1/02* (2006.01)

(52) U.S. Cl.
CPC ..... *F25J 1/021* (2013.01); *F25J 1/004* (2013.01); *F25J 1/0022* (2013.01); *F25J 1/0052* (2013.01); *F25J 1/0072* (2013.01); *F25J 1/0095* (2013.01); *F25J 1/023* (2013.01); *F25J 1/0231* (2013.01); *F25J 1/0249* (2013.01); *F25J 2220/62* (2013.01); *F25J 2220/64* (2013.01)

(58) Field of Classification Search
USPC ..... 62/612, 618, 620, 630
See application file for complete search history.

(56) References Cited

U.S. PATENT DOCUMENTS

| | | | | |
|---|---|---|---|---|
| 2,186,029 | A * | 1/1940 | Lassiat | 208/93 |
| 4,012,212 | A * | 3/1977 | Kniel | 62/621 |
| 4,548,629 | A | 10/1985 | Chiu | |
| 4,727,723 | A | 3/1988 | Durr | |
| 5,651,270 | A | 7/1997 | Low et al. | |
| 6,070,429 | A * | 6/2000 | Low et al. | 62/612 |
| 6,253,574 | B1 * | 7/2001 | Stockmann et al. | 62/612 |
| 6,425,264 | B1 | 7/2002 | Wong et al. | |
| 6,789,394 | B2 * | 9/2004 | Elion et al. | 62/612 |
| 7,082,787 | B2 * | 8/2006 | Lee et al. | 62/612 |
| 7,608,231 | B2 * | 10/2009 | Bellussi et al. | 423/224 |
| 2005/0279133 | A1 * | 12/2005 | Eaton | 62/613 |
| 2005/0284176 | A1 * | 12/2005 | Eaton et al. | 62/613 |
| 2007/0012071 | A1 * | 1/2007 | Huang et al. | 62/612 |

FOREIGN PATENT DOCUMENTS

WO 2006009610 A2 1/2006

* cited by examiner

*Primary Examiner* — David Teitelbaum
(74) *Attorney, Agent, or Firm* — ConocoPhillips Company

(57) ABSTRACT

A liquefied natural gas (LNG) facility that employs a system to remove incondensable material from one or more refrigeration cycles within the facility. One or more embodiments of the present invention can be advantageously employed in an open-loop refrigeration cycle to remove at least a portion of one or more high vapor pressure components that have accumulated in the refrigerant cycle over time. In addition, several embodiments can be advantageously employed to stabilize facility operation in the event of drastic changes to the concentration of the natural gas feed stream introduced into the facility.

13 Claims, 3 Drawing Sheets

SYSTEM FOR INCONDENSABLE COMPONENT SEPARATION IN A LIQUEFIED NATURAL GAS FACILITY

CROSS-REFERENCE TO RELATED APPLICATIONS

This application claims priority benefit under 35 U.S.C. Section 119(e) of U.S. Provisional Patent Ser. No. 61/095,189 filed on Sep. 8, 2008, the entire disclosure of which is incorporated herein by reference.

BACKGROUND

1. Field of the Invention

This invention relates to methods and apparatuses for liquefying natural gas. In another aspect, the invention concerns a liquefied natural gas (LNG) facility employing a system for separating accumulated incondensable components from one or more refrigeration cycles in an LNG facility.

2. Description of Related Art

Cryogenic liquefaction is commonly used to convert natural gas into a more convenient form for transportation and/or storage. Because liquefying natural gas greatly reduces its specific volume, large quantities of natural gas can be economically transported and/or stored in liquefied form.

Transporting natural gas in its liquefied form can effectively link a natural gas source with a distant market when the source and market are not connected by a pipeline. This situation commonly arises when the source of natural gas and the market for the natural gas are separated by large bodies of water. In such cases, liquefied natural gas (LNG) can be transported from the source to the market using specially designed ocean-going LNG tankers.

Storing natural gas in its liquefied form can help balance out periodic fluctuations in natural gas supply and demand. In particular, LNG can be "stockpiled" for use when natural gas demand is low and/or supply is high. As a result, future demand peaks can be met with LNG from storage, which can be vaporized as demand requires.

Several methods exist for liquefying natural gas. Some methods produce a pressurized LNG (PLNG) product that is useful, but requires expensive pressure-containing vessels for storage and transportation. Other methods produce an LNG product having a pressure at or near atmospheric pressure. In general, these non-pressurized LNG production methods involve cooling a natural gas stream via indirect heat exchange with one or more refrigerants and then expanding the cooled natural gas stream to near atmospheric pressure. In addition, most LNG facilities employ one or more systems to remove contaminants (e.g., water, acid gases, nitrogen, and ethane and heavier components) from the natural gas stream at different points during the liquefaction process.

Typically, LNG facilities employ one or more refrigeration cycles to cool the incoming natural gas stream by first condensing a stream of refrigerant and then contacting the vaporizing the refrigerant with the natural gas via direct or indirect heat exchange in order to reduce the temperature of the natural gas below its liquefaction point. Over time, one or more relatively incondensable components (e.g., air, nitrogen, helium, hydrogen, or argon) can build up in the refrigerant. Increased concentration of incondensable materials is highly undesirable because, for example, these relatively higher vapor pressure components don't condense at the operating conditions of the refrigeration cycle, thereby effectively diminishing the refrigeration capacity (i.e., duty) of the contaminated refrigeration cycle.

While the build up of incondensable materials in a closed-loop refrigeration cycle can occur, the problem is more pronounced in open-loop cycles, which employ a portion of the natural gas feed stream as the refrigerant. Minor changes in the feed gas composition can create substantial process disturbances and drastic swings in the composition of the natural gas feed stream can result in significant operational upsets, ultimately reducing the production of on-spec LNG produced from the facility for a certain period of time.

SUMMARY

In one embodiment of the present invention, there is provided a process for liquefying a natural gas stream. According to one embodiment, the process comprises the following steps: (a) cooling the natural gas stream via indirect heat exchange with a first refrigerant in a first closed-loop refrigeration cycle to thereby provide a cooled natural gas stream; (b) further cooling at least a portion of the cooled natural gas stream via indirect heat exchange with a predominantly methane refrigerant in an open-loop refrigeration cycle to thereby provide a further cooled natural gas stream, wherein the open-loop refrigeration cycle comprises a refrigerant compressor; and (c) separating at least a portion of the further cooled natural gas stream in a first separation vessel to thereby provide a predominantly liquid stream and a predominantly vapor stream, wherein at least a portion of the further cooled natural gas stream introduced into the first separation vessel has passed through the refrigerant compressor, wherein the pressure of the further cooled natural gas stream introduced into the first separation vessel is greater than about 1,690 kPa.

In another embodiment of the present invention, there is provided a process for liquefying a natural gas stream. The process of this embodiment comprises the following steps: (a) cooling the natural gas stream in a first refrigeration cycle via indirect heat exchange with a first refrigerant to thereby provide a cooled natural gas stream; (b) separating at least a portion of the cooled natural gas stream into a predominantly methane overhead stream and a heavies-rich bottoms stream in a heavies removal column; (c) flashing at least a portion of the predominantly methane overhead stream to thereby provide a predominantly vapor stream and a predominantly liquid stream; (d) compressing at least a portion of the predominantly vapor stream to thereby provide a compressed vapor stream; (e) cooling at least a portion of the compressed vapor stream via indirect heat exchange with a second refrigerant in a second refrigeration cycle to thereby provide a cooled compressed stream; (f) separating at least a portion of the cooled compressed stream in a separation vessel to thereby provide a predominantly vapor overhead stream and a predominantly liquid bottoms stream; and (g) introducing a first portion of the predominantly liquid bottoms stream into the heavies removal column as a reflux stream.

In yet another embodiment of the present invention, there is provided A facility for liquefying a natural gas stream, the facility comprising a first closed-loop refrigeration cycle, a heavies removal column, a second closed-loop refrigeration cycle, an expander, a refrigerant compressor, and a refrigerant accumulator. The first closed-loop refrigeration cycle comprises a first warm natural gas inlet and a first cool natural gas outlet and the first closed-loop refrigeration cycle is operable to cool at least a portion of the natural gas stream via indirect heat exchange with a first refrigerant to thereby provide a cooled natural gas stream withdrawn via the first cool natural gas outlet. The heavies removal column defines a first fluid inlet, a first vapor outlet, a first liquid outlet, and a first reflux inlet. The first fluid inlet of the heavies removal column is in fluid flow communication with the first cool natural gas outlet of the first refrigeration cycle. The heavies removal column is operable to separate at least a portion of the cooled natural gas stream into a predominantly liquid stream withdrawn via the first liquid outlet and a predominantly vapor stream withdrawn via the first vapor outlet. The second closed-loop refrigeration cycle comprises a second warm natural gas inlet and a second cool natural gas outlet. The second warm natural gas inlet is in fluid flow communication with the first vapor outlet. The second closed-loop refrigeration cycle is operable to cool at least a portion of the predominantly vapor stream withdrawn from the first vapor outlet of the heavies removal column via indirect heat exchange with a second refrigerant to thereby provide a further cooled natural gas stream. The expander defines a high pressure inlet and a low pressure outlet. The high pressure inlet is in fluid flow communication with the second cool natural gas outlet of the second closed-loop refrigeration cycle. The expander is operable reduce the pressure of at least a portion of the further cooled natural gas stream withdrawn from the second closed-loop refrigeration cycle to thereby provide a two-phase fluid stream withdrawn via the low pressure outlet. The refrigerant compressor defines a suction port and a discharge port, and the suction port is in fluid flow communication with the low pressure outlet of the expander. The refrigerant compressor is operable to compress at least a portion of the two-phase stream withdrawn from the low pressure outlet of the expander to thereby provide a compressed refrigerant stream withdrawn via the discharge port. The refrigerant accumulator defines a second fluid inlet, a second vapor outlet, and a second liquid outlet. The second fluid inlet of the refrigerant accumulator is in fluid flow communication with the discharge port of the refrigerant compressor. The refrigerant accumulator is operable to separate at least a portion of said compressed refrigerant stream exiting said refrigerant compressor into a second predominantly vapor stream withdrawn from said second vapor outlet and a second predominantly liquid stream withdrawn from said second liquid outlet. The second liquid outlet of the refrigerant accumulator is in fluid flow communication with the first reflux inlet of the heavies removal column.

BRIEF DESCRIPTION OF THE FIGURES

Certain embodiments of the present invention are described in detail below with reference to the enclosed figures, wherein.

DETAILED DESCRIPTION

In accordance with one embodiment, the present invention can be implemented in a facility used to cool natural gas to its liquefaction temperature to thereby produce liquefied natural gas (LNG). The LNG facility generally employs one or more refrigerants to extract heat from the natural gas and then reject the heat to the environment. Numerous configurations of LNG systems exist, and the present invention may be implemented in many different types of LNG systems.

In one embodiment, the present invention can be implemented in a mixed refrigerant LNG system. Examples of mixed refrigerant processes can include, but are not limited to, a single refrigeration system using a mixed refrigerant, a propane pre-cooled mixed refrigerant system, and a dual mixed refrigerant system. In general, mixed refrigerants can comprise hydrocarbon and/or non-hydrocarbon components. Examples of suitable hydrocarbon components typically employed in mixed refrigerants can include, but are not limited to, methane, ethane, ethylene, propane, propylene, as well as butane and butylene isomers. Non-hydrocarbon components generally employed in mixed refrigerants can include carbon dioxide and nitrogen. Mixed refrigerant processes employ at least one mixed component refrigerant, but can additionally employ one or more pure-component refrigerants as well.

In another embodiment, the present invention is implemented in a cascade LNG system employing a cascade-type refrigeration process using one or more pure component refrigerants. The refrigerants utilized in cascade-type refrigeration processes can have successively lower boiling points in order to maximize heat removal from the natural gas stream being liquefied. Additionally, cascade-type refrigeration processes can include some level of heat integration. For example, a cascade-type refrigeration process can cool one or more refrigerants having a higher volatility via indirect heat exchange with one or more refrigerants having a lower volatility. In addition to cooling the natural gas stream via indirect heat exchange with one or more refrigerants, cascade and mixed-refrigerant LNG systems can employ one or more expansion cooling stages to simultaneously cool the LNG while reducing its pressure to near atmospheric pressure.

Figure 1:
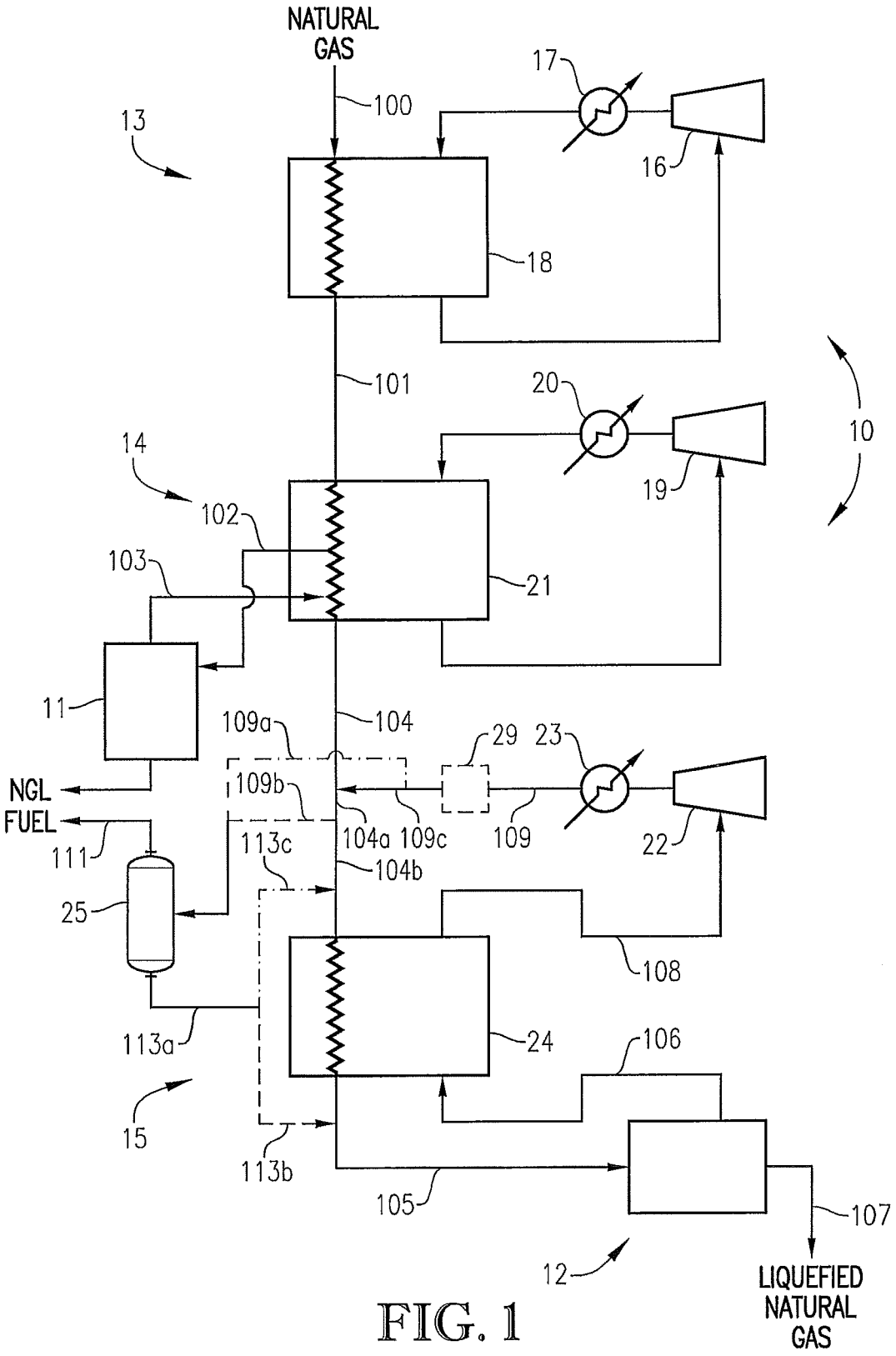
FIG. 1 is a simplified overview of a cascade-type LNG facility configured in accordance with one embodiment of the present invention.

FIG. 1 illustrates one embodiment of a simplified LNG facility employing a turbine inlet air cooling system capable of increasing the efficiency of one or more gas turbines employed therein. The cascade-type LNG facility of FIG. 1 generally comprises a cascade cooling section 10, a heavies removal zone 11, and an expansion cooling section 12. Cascade cooling section 10 is depicted as comprising a first mechanical refrigeration cycle 13, a second mechanical refrigeration cycle 14, and a third mechanical refrigeration cycle 15. In general, first, second, and third refrigeration cycles 13, 14, 15 can be closed-loop refrigeration cycles, open-loop refrigeration cycles, or any combination thereof. In one embodiment of the present invention, first and second refrigeration cycles 13 and 14 can be closed-loop cycles, and third refrigeration cycle 15 can be an open-loop cycle that utilizes a refrigerant comprising at least a portion of the natural gas feed stream undergoing liquefaction.

In accordance with one embodiment of the present invention, first, second, and third refrigeration cycles 13, 14, 15 can employ respective first, second, and third refrigerants having successively lower boiling points. For example, the first, second, and third refrigerants can have mid-range boiling points at standard pressure (i.e., mid-range standard boiling points) within about 10° C. (18° F.), within about 5° C. (9° F.), or within 2° C. (3.6° F.) of the standard boiling points of propane, ethylene, and methane, respectively. In one embodiment, the first refrigerant can comprise at least about 75 mole percent, at least about 90 mole percent, at least 95 mole percent, or can consist essentially of propane, propylene, or mixtures thereof. The second refrigerant can comprise at least about 75 mole percent, at least about 90 mole percent, at least 95 mole percent, or can consist essentially of ethane, ethylene, or mixtures thereof. The third refrigerant can comprise at least about 75 mole percent, at least about 90 mole percent, at least 95 mole percent, or can consist essentially of methane.

As shown in FIG. 1, first refrigeration cycle 13 can comprise a first cooler 17 and a first refrigerant chiller 18. First refrigerant compressor 16 can discharge a stream of compressed first refrigerant, which can subsequently be cooled and at least partially liquefied in cooler 17. The resulting refrigerant stream can then enter first refrigerant chiller 18, wherein at least a portion of the refrigerant stream can cool the incoming natural gas stream in conduit 100 via indirect heat exchange with the vaporizing first refrigerant. The gaseous refrigerant can exit first refrigerant chiller 18 and can then be routed to an inlet port of first refrigerant compressor 16 to be recirculated as previously described.

First refrigerant chiller 18 can comprise one or more cooling stages operable to reduce the temperature of the incoming natural gas stream in conduit 100 by an amount in the range of from about 20° C. (36° F.) to about 120° C. (216° F.), about 25° C. (45° F.) to about 110° C. (198° F.), or 40° C. (72° F.) to 85° C. (153° F.). Typically, the natural gas entering first refrigerant chiller 18 via conduit 100 can have a temperature in the range of from about −20° C. (−4° F.) to about 95° C. (203° F.), about −10° C. (14° F.) to about 75° C. (167° F.), or 10° C. (50° F.) to 50° C. (122° F.). In general, the temperature of the cooled natural gas stream exiting first refrigerant chiller 18 can be in the range of from about −55° C. (−67° F.) to about −15° C. (5° F.), about −45° C. (−49° F.) to about −20° C. (−4° F.), or −40° C. (−40° F.) to −30° C. (−22° F.). In general, the pressure of the natural gas stream in conduit 100 can be in the range of from about 690 kPa (100.1 psi) to about 20,690 kPa (3,000.8 psi), about 1,725 kPa (250.2 psi) to about 6,900 kPa (1,000.8 psi), or 2,760 kPa (400.3 psi) to 5,500 kPa (797.7 psi). Because the pressure drop across first refrigerant chiller 18 can be less than about 690 kPa (100.1 psi), less than about 345 kPa (50 psi), or less than 175 kPa (25.4 psi), the cooled natural gas stream in conduit 101 can have substantially the same pressure as the natural gas stream in conduit 100.

As illustrated in FIG. 1, the cooled natural gas stream (also referred to herein as the "cooled predominantly methane stream") exiting first refrigeration cycle 13 can then enter second refrigeration cycle 14, which can comprise a second refrigerant compressor 19, a second cooler 20, and a second refrigerant chiller 21. Compressed refrigerant can be discharged from second refrigerant compressor 19 and can subsequently be cooled and at least partially liquefied in cooler 20 prior to entering second refrigerant chiller 21. Second refrigerant chiller 21 can employ a plurality of cooling stages to progressively reduce the temperature of the predominantly methane stream in conduit 101 by an amount in the range of from about 30° C. (54° F.) to about 100° C. (180° F.), about 35° C. (63° F.) to about 85° C. (153° F.), or 50° C. (90° F.) to 70° C. (126° F.) via indirect heat exchange with the vaporizing second refrigerant. As shown in FIG. 1, the vaporized second refrigerant can then be returned to an inlet port of second refrigerant compressor 19 prior to being recirculated in second refrigeration cycle 14, as previously described.

The natural gas feed stream in conduit 100 will usually contain ethane and heavier components ($C_2$+), which can result in the formation of a $C_2$+ rich liquid phase in one or more of the cooling stages of second refrigeration cycle 14. In order to remove the undesired heavies material from the predominantly methane stream prior to complete liquefaction, at least a portion of the natural gas stream passing through second refrigerant chiller 21 can be withdrawn via conduit 102 and processed in heavies removal zone 11, as shown in FIG. 1. The stream in conduit 102 can have a temperature in the range of from about −110° C. (−166° F.) to about −45° C. (−49° F.), about −95° C. (−139° F.) to about −50° C. (−58° F.), or −85° C. (−121° F.) to −65° C. (−85° F.). Typically, the stream in conduit 102 can have pressure that is within about 5 percent, about 10 percent, or 15 percent of the pressure of the natural gas feed stream in conduit 100.

Heavies removal zone 11 can comprise one or more gas-liquid separators operable to remove at least a portion of the heavy hydrocarbon material from the predominantly methane stream. Typically, heavies removal zone 11 can be operated to remove benzene and other high molecular weight aromatic components, which can freeze in subsequent liquefaction steps and plug downstream process equipment. In addition, heavies removal zone 11 can be operated to recover the heavy hydrocarbons in a natural gas liquids (NGL) product stream. Examples of typical hydrocarbon components included in NGL streams can include ethane, propane, butane isomers, pentane isomers, and hexane and heavier components (i.e., $C_6$+). The extent of NGL recovery from the predominantly methane stream ultimately impacts one or more final characteristics of the LNG product, such as, for example, Wobbe index, BTU content, higher heating value (HHV), ethane content, and the like. In one embodiment, the NGL product stream exiting heavies removal zone 11 can be subjected to further fractionation in order to obtain one or more pure component streams. Often, NGL product streams and/or their constituents can be used as gasoline blendstock.

As shown in FIG. 1, a heavies-depleted, predominantly methane stream can be withdrawn from heavies removal zone 11 via conduit 103 and can be routed back to second refrigeration cycle 14. Generally, the stream in conduit 103 can have a temperature in the range of from about −100° C. (−148° F.) to about −40° C. (−40° F.), about −90° C. (−130° F.) to about −50° C. (−58° F.), or −80° C. (−112° F.) to −55° C. (−67° F.). The pressure of the stream in conduit 103 can typically be in the range of from about 1,380 kPa (200.15 psi) to about 8,275 kPa (1200.2 psi), about 2,420 kPa (351 psi) to about 5,860 kPa (849.9 psi), or 3,450 kPa (500.4 psi) to 4,830 kPa (700.5 psi).

As shown in FIG. 1, the predominantly methane stream in conduit 103 can subsequently be further cooled via second refrigerant chiller 21. In one embodiment, the stream exiting second refrigerant chiller 21 via conduit 104 can be completely liquefied and can have a temperature in the range of from about −135° C. (−211° F.) to about −55° C. (−67° F.), about −115° C. (−175° F.) to about −65° C. (−85° F.), or −95° C. (−139° F.) to −85° C. (−121° F.). Generally, the stream in conduit 104 can be at approximately the same pressure the natural gas stream entering the LNG facility in conduit 100.

As illustrated in FIG. 1, the pressurized LNG-bearing stream in conduit 104 can combine with a stream in conduit 109 prior to entering third refrigeration cycle 15, which is depicted as generally comprising a third refrigerant compressor 22, a cooler 23, and a third refrigerant economizer 24. Compressed refrigerant discharged from third refrigerant compressor 22 enters cooler 23, wherein the refrigerant stream is cooled via indirect heat exchange prior to entering cooling zone 29. Cooling zone 29 can comprise one or more cooling stages operable to cool and at least partially condense the predominantly methane stream in conduit 109. In one embodiment, cooling zone 29 can be at least partly defined within one or more of the first or second refrigerant chillers 18, 21 and/or within third refrigerant economizer 24. When a portion of cooling zone 29 is defined within one or more of first, second, and third refrigeration cycles 13, 14, 15, in one embodiment, the respective refrigeration cycles can define one or more additional cooling passes.

In one embodiment wherein third refrigeration cycle 15 comprises an open-loop refrigeration cycle, the cooled stream exiting cooling zone 29 can optionally be split into two portions. According to one embodiment, the first portion, illustrated by dot-dashed line 109*a* can be routed into a yet-to-be-discussed refrigerant accumulator 25, while the second portion, represented by the solid line 109*c*, can combine with the stream withdrawn from second refrigerant chiller 21 in conduit 104, as illustrated in FIG. 1. In general, the first portion routed to refrigerant accumulator 25 can comprise at least a portion, a major portion, or substantially all of the refrigerant stream exiting cooling zone 29. In another embodiment, substantially none of the stream exiting cooling zone 29 can be routed to refrigerant accumulator 25 and substantially all of the stream exiting cooling zone 29 can combine with the cooled predominantly methane stream exiting second refrigerant chiller 21 in conduit 104.

As illustrated by one embodiment shown in FIG. 1, the combined stream in conduit 104*a*, which may or may not comprise at least a portion of the compressed stream exiting cooling zone 29, can optionally be split into a third portion and a fourth portion. According to one embodiment, the third portion, depicted by dashed line 109*b*, can be routed to refrigerant accumulator 25, while the fourth portion, illustrated by conduit 104*b*, can enter third refrigerant chiller 24, as shown in FIG. 1. In general, the third portion routed to refrigerant accumulator 25 can comprise at least a portion, a major portion, or substantially all of the combined stream in conduit 104*a*, while, in another embodiment, substantially none of the stream in conduit 104 can be routed to refrigerant accumulator 25, such that a substantial portion of the combined predominantly methane stream in conduit 104 enters third refrigerant chiller 24.

In general, refrigerant accumulator 25 can serve a number of functions within LNG facility 10 as illustrated in FIG. 1. In one embodiment, refrigerant accumulator 25 can be operable to remove at least a portion of the incondensable material present in the cooled predominantly methane stream exiting second refrigeration cycle 13 via conduit 104, as shown in FIG. 1. In another embodiment, refrigerant accumulator 25 can facilitate more efficient separation in heavies removal zone 11, by, for example, allowing one or more distillation columns in heavies removal zone 11 to operate more efficiently at a lower pressure. In yet another embodiment, refrigerant accumulator 25 can provide sufficient surge time to allow the operators of LNG facility 10 to maintain system control and stability during process upsets by providing adequate surge time for the refrigerant employed in the open-loop refrigerant cycle.

In general, refrigerant accumulator 25 can be any vessel capable of receiving a one-phase or two-phase fluid stream. In one embodiment, refrigerant accumulator 25 can comprise a single-stage flash vessel, while, in another embodiment, refrigerant accumulator 25 can comprise in the range of from about 2 to about 15, about 3 to about 10, or 5 to 8 theoretical separation stages. Refrigerant accumulator 25 can employ one or more types of vessel internals (e.g., trays, random packing, structured packing, or any combination thereof), or, refrigerant accumulator 25 can be substantially empty. Refrigerant accumulator 25 can comprise a horizontally-elongated separation vessel or a vertically-elongated separation vessel. In one embodiment depicted in FIG. 1, refrigerant accumulator 35 can be a vertically-oriented, single-stage flash vessel.

As discussed previously, in one embodiment, refrigerant accumulator 25 can be operable to separate the fluid stream introduced thereto via conduits 109*a* and/or 109*b* into a incondensables-depleted, predominantly liquid bottoms fraction in conduit 113*a* and an incondensables-rich, predominantly vapor overhead fraction in conduit 111, as illustrated in FIG. 1. As used herein, the term "incondensables" refers to components having a vapor pressure higher than the vapor pressure of methane at standard conditions of 60° F. and 1 atmosphere. Examples of incondensables can include, but are not limited to, hydrogen, helium, nitrogen, neon, oxygen, carbon monoxide, carbon dioxide, argon, air, and the like. In one embodiment, incondensables separation vessel can have a separation efficiency of at least about 25 percent, at least about 50 percent, at least about 75 percent, or at least 80 percent, wherein separation efficiency is defined by the following equation: [(mass of incondensables exiting refrigerant accumulator 25 via conduit 111)/(mass of incondensables entering refrigerant accumulator 25 in conduit 109*a* and/or 109*b*)], expressed as a percentage. In one embodiment, refrigerant accumulator 25 can be operated in a batchwise or semi-batch manner, while, in another embodiment refrigerant accumulator 25 can be used for the continuous separation of incondensable material from refrigerant employed in open-loop refrigeration cycle 15.

In one embodiment, the pressure of the stream introduced into refrigerant accumulator 25 can be greater than about 1,690 kPa (245.1 psia), greater than about 2,070 kPa (300.2 psia), greater than about 2,585 kPa (374.9 psia), or in the range of from about 2,760 kPa (400.3 psia) to about 4,830 kPa (700.5 psia), about 3,790 kPa (549.7 psia) to about 4,485 kPa (650.5 psia), or 3,860 kPa (559.8 psia) to 4,070 kPa (650.5 psia), while the temperature of the cooled stream in conduits 109*a* and/or 109*b* can be in the range of from about −80° C. (−112° F.) to about −105° C. (−157° F.) or about −85° C. (−121° F.) to about −95° C. (−139° F.). In another embodiment, the streams in conduits 109*a* and/or 109*b* can comprise at least about 0.5 mole percent, at least about 1 mole percent, at least about 2 mole percent, at least about 5 mole percent, at least 10 mole percent incondensable material, while the concentration of incondensable materials in the relatively incondensables-rich overhead stream withdrawn from refrigerant accumulator 25 can be greater than about 10 mole percent, greater than about 25 mole percent, greater than about 50 mole percent, or greater than 75 mole percent incondensables.

As shown in FIG. 1, the incondensable-depleted product stream can be withdrawn from refrigerant accumulator 25 via conduit 113*a*. In one embodiment, the concentration of incondensable materials in the relatively incondensables-depleted bottoms stream withdrawn from refrigerant accumulator 25 via conduit 113*a* can comprise less than about 5 mole percent, less than about 2 mole percent, less than about 1 mole percent, or less than 0.5 mole percent incondensable material. The incondensable-depleted product stream in conduit 113*a* can then optionally be routed to the inlet (via conduit 113*c*) and/or outlet (via conduit 113*d*) of third refrigerant economizer 24, as illustrated in FIG. 1.

In another embodiment, refrigerant accumulator 25 can provide enough refrigerant surge time to allow the operators of LNG facility 10 to react to drastic process changes while still maintaining system stability. In one embodiment, refrigerant accumulator 25 can have a volume sufficient to provide at least about 5 minutes, at least about 10 minutes, or at least about 15 minutes, or at least 30 minutes of surge time. This is in direct contrast to other conventional open-loop refrigerant cycles, which can be highly sensitive to drastic changes in facility operating conditions.

In yet another embodiment, refrigerant accumulator 25 can substantially increase the separation efficiency of one or more gas-liquid separation vessels employed in heavies removal zone 11 by allowing at least one of the distillation columns employed therein to operate at a substantially lower pressure than would be possible in the absence of open-loop refrigerant accumulator 25. For example, in one embodiment, the overhead pressures of the refrigerant accumulator 25 can be in the range of from about 170 kPa (24.6 psia) to about 1,035 kPa (150.1 psia), about 345 kPa (50 psia) to about 865 kPa (125.5 psia), or 515 kPa (74.7 psia) to 725 kPa (105.1 psia) higher than the overhead pressure of the highest pressure distillation column employed in heavies removal zone 11.

Turning now to third refrigeration cycle 15 illustrated in FIG. 1, third refrigerant economizer 24 can comprise one or more cooling stages operable to further cool the pressurized predominantly methane stream in conduit 104 via indirect heat exchange with the vaporizing refrigerant. In one embodiment, the temperature of the pressurized LNG-bearing stream in conduit 105 can be reduced by an amount in the range of from about 2° C. (3.6° F.) to about 35° C. (63° F.), about 3° C. (5.4° F.) to about 30° C. (54° F.), or 5° C. (9° F.) to 25° C. (45° F.) in third refrigerant economizer 24. Typically, the temperature of the pressurized LNG-bearing stream exiting third refrigerant economizer 24 can be in the range of from about −170° C. (−274° F.) to about −55° C. (−67° F.), about −145° C. (−229° F.) to about −70° C. (−94° F.), or −130° C. (−202° F.) to −85° C. (−121° F.).

As shown in FIG. 1, the cooled LNG-bearing stream exiting third refrigerant economizer 24 can then be routed to expansion cooling section 12, wherein the stream can be at least partially subcooled via sequential pressure reduction to near atmospheric pressure by passage through one or more expansion stages. Expansion cooling section 12 can comprise in the range of from about 1 to about 6, about 2 to about 5, or 3 to 4 expansion stages. In one embodiment, each expansion stage can reduce the temperature of the LNG-bearing stream by an amount in the range of from about 5° C. (9° F.) to about 35° C. (63° F.), about 7.5° C. (13.5° F.) to about 30° C. (54° F.), or 10° C. (18° F.) to 25° C. (45° F.). Each expansion stage comprises one or more expanders, which reduce the pressure of the liquefied stream to thereby evaporate or flash a portion thereof. Examples of suitable expanders can include, but are not limited to, Joule-Thompson valves, venturi nozzles, and turboexpanders. In one embodiment of the present invention, expansion section 12 can reduce the pressure of the LNG-bearing stream in conduit 105 by an amount in the range of from about 520 kPa (75.4 psi) to about 3,100 kPa (449.6 psi), about 860 kPa (124.7 psi) to about 2,070 kPa (300.2 psi), or 1,030 kPa (149.4 psi) to 1,550 kPa (224.8 psi).

Each expansion stage may additionally employ one or more vapor-liquid separators operable to separate the vapor phase (i.e., the flash gas stream) from the cooled liquid stream. As previously discussed, third refrigeration cycle 15 can comprise an open-loop refrigeration cycle, closed-loop refrigeration cycle, or any combination thereof. When third refrigeration cycle 15 comprises a closed-loop refrigeration cycle, the flash gas stream can be used as fuel within the facility or routed downstream for storage, further processing, and/or disposal. When third refrigeration cycle 15 comprises an open-loop refrigeration cycle, at least a portion of the flash gas stream exiting expansion section 12 can be used as a refrigerant to cool at least a portion of the natural gas stream in conduit 104. Generally, when third refrigerant cycle 15 comprises an open-loop cycle, the third refrigerant can comprise at least 50 weight percent, at least about 75 weight percent, or at least 90 weight percent of flash gas from expansion section 12, based on the total weight of the stream. As illustrated in FIG. 1, the flash gas exiting expansion section 12 via conduit 106 can enter third refrigerant economizer 24, wherein the stream can cool at least a portion of the natural gas stream entering third refrigerant economizer 24 via conduit 104. The resulting warmed refrigerant stream can then exit third refrigerant economizer 24 via conduit 108 and can thereafter be routed to an inlet port of third refrigerant compressor 22. As shown in FIG. 1, third refrigerant compressor 22 discharges a stream of compressed third refrigerant, which is thereafter cooled in cooler 23. The resulting cooled methane stream in conduit 109 can then be further cooled in cooling zone 29 before combining with the natural gas stream in conduit 104 prior to entering third refrigerant economizer 24, as previously discussed.

As shown in FIG. 1, the liquid stream exiting expansion section 12 via conduit 107 can comprise LNG. In one embodiment, the LNG in conduit 107 can have a temperature in the range of from about −130° C. (−202° F.) to about −185° C. (−301° F.), about −145° C. (−229° F.) to about −170° C. (−274° F.), or −155° C. (−247° F.) to −165° C. (−265° F.) and a pressure in the range of from about 0 kPa (0 psia) to about 345 kPa (50 psia), about 35 kPa (5.1 psia) to about 210 kPa (30.5 psia), or 82.7 kPa (10.2 psia) to 210 kPa (20.3 psia).

According to one embodiment, the LNG in conduit 107 can comprise at least about 85 volume percent of methane, at least about 87.5 volume percent methane, at least about 90 volume percent methane, at least about 92 volume percent methane, at least about 95 volume percent methane, or at least 97 volume percent methane. In another embodiment, the LNG in conduit 107 can comprise less than about 15 volume percent ethane, less than about 10 volume percent ethane, less than about 7 volume percent ethane, or less than 5 volume percent ethane. In yet another embodiment, the LNG in conduit 107 can have less than about 2 volume percent $C_3^+$ material, less than about 1.5 volume percent $C_3^+$ material, less than about 1 volume percent $C_3^+$ material, or less than 0.5 volume percent $C_3^+$ material. In one embodiment (not shown), the LNG in conduit 107 can subsequently be routed to storage and/or shipped to another location via pipeline, ocean-going vessel, truck, or any other suitable transportation means. In one embodiment, at least a portion of the LNG can be subsequently vaporized for pipeline transportation or for use in applications requiring vapor-phase natural gas.

Figure 2:
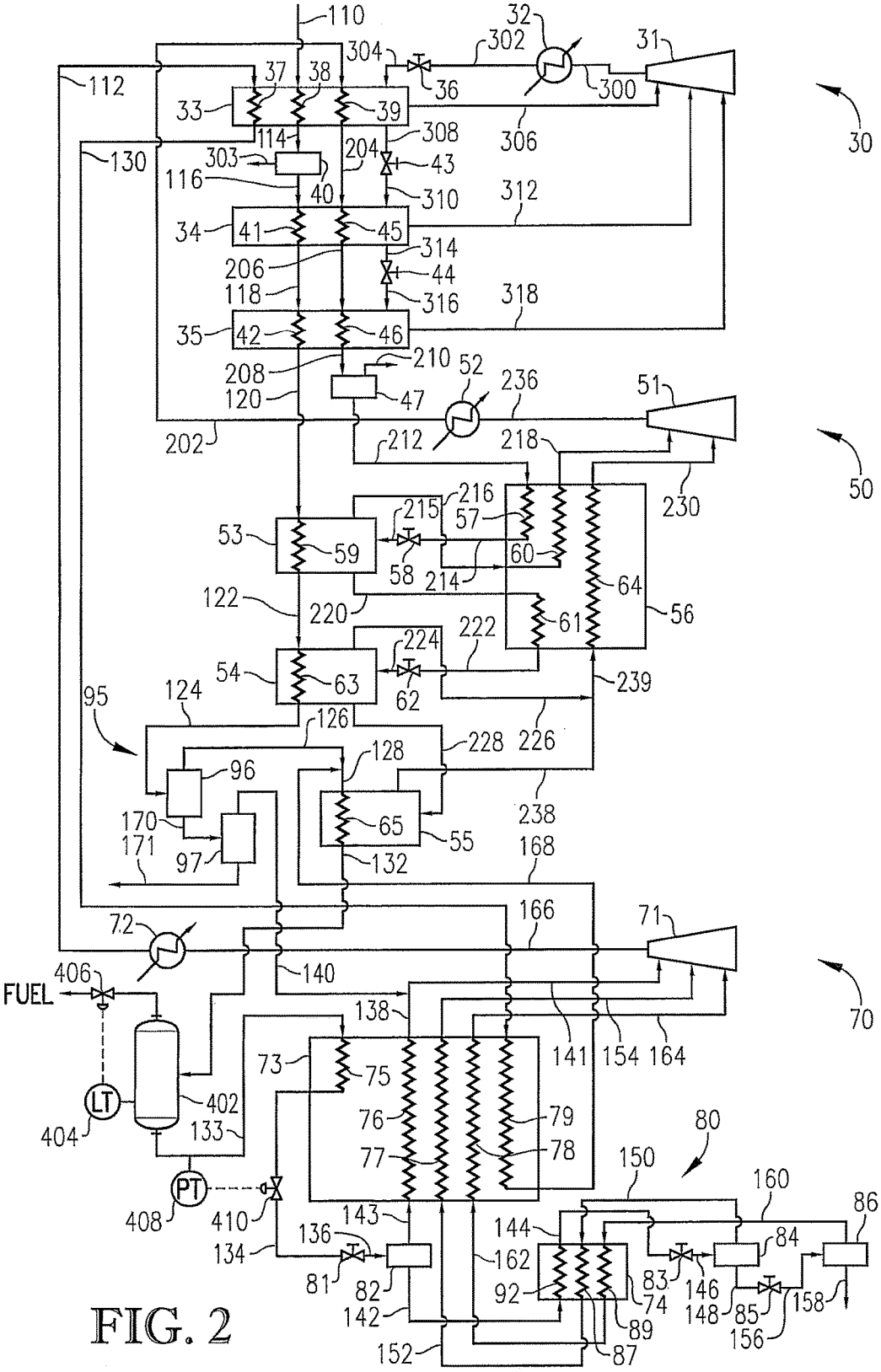
FIG. 2 is a schematic diagram of an LNG facility configured in accordance with one embodiment of the present invention.
Figure 3:
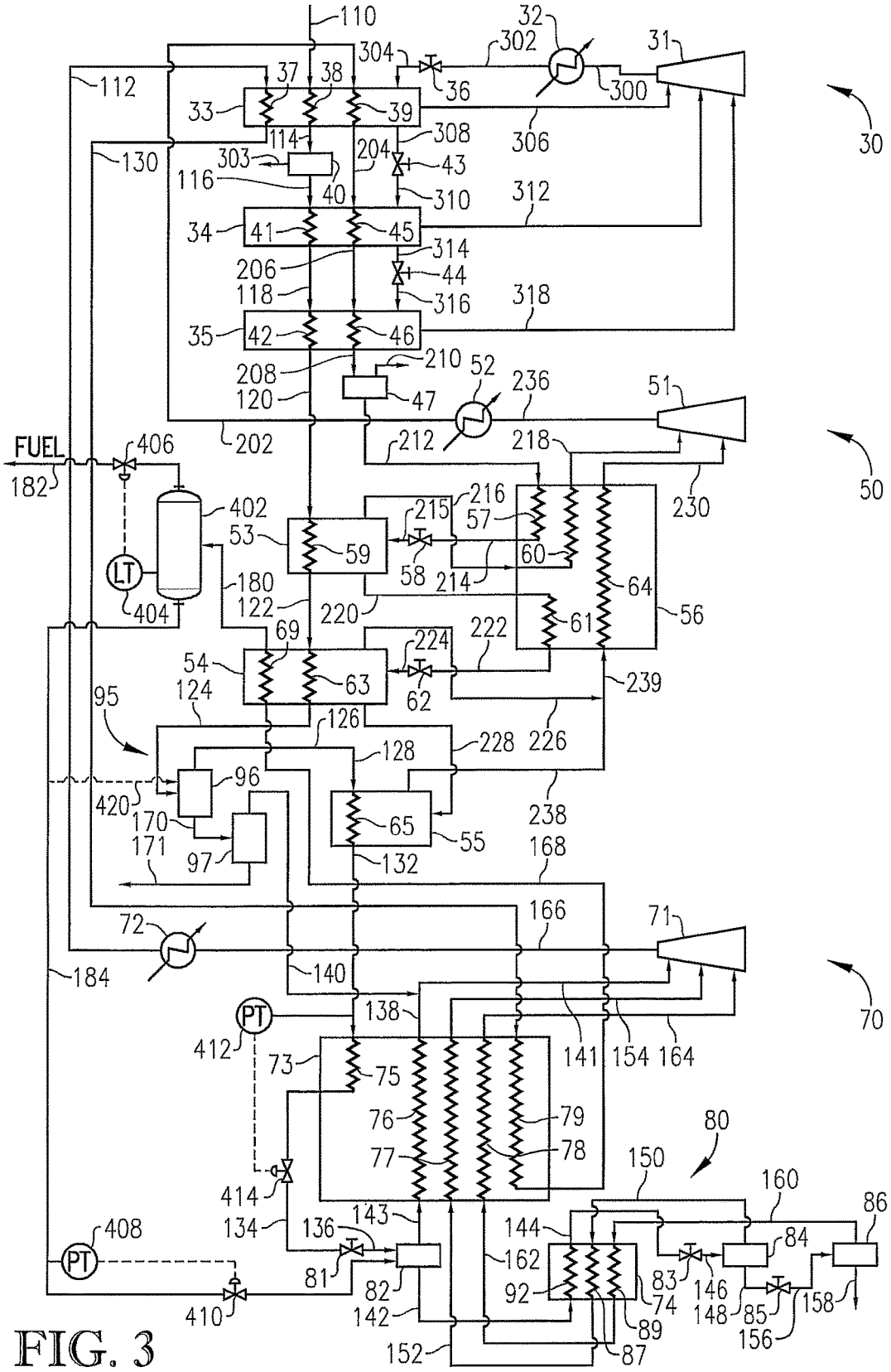
FIG. 3 is a schematic diagram of an LNG facility configured in accordance with another embodiment of the present invention.

Turning now to FIGS. 2 and 3, embodiments of specific configurations of LNG facilities as described previously with respect to FIG. 1 are illustrated. To facilitate an understanding of FIGS. 2 and 3, the following numeric nomenclature was employed. Items numbered 31 through 49 correspond to process vessels and equipment directly associated with first propane refrigeration cycle 30, and items numbered 51 through 69 correspond to process vessels and equipment related to second ethylene refrigeration cycle 50. Items numbered 71 through 94 correspond to process vessels and equipment associated with third methane refrigeration cycle 70 and/or expansion section 80. Items numbered 96 through 99 are process vessels and equipment associated with heavies removal zone 95. Items numbered 100 through 199 correspond to flow lines or conduits that contain predominantly methane streams. Items numbered 200 through 299 correspond to flow lines or conduits which contain predominantly ethylene streams. Items numbered 300 through 399 correspond to flow lines or conduits that contain predominantly propane streams. Items numbered 400 through 499 correspond to other process vessels and equipment employed in the LNG facilities depicted in FIGS. 2 and 3.

Referring first to FIG. 2, a cascade-type LNG facility in accordance with one embodiment of the present invention is illustrated. The LNG facility depicted in FIG. 2 generally comprises a propane refrigeration cycle 30, an ethylene refrigeration cycle 50, a methane refrigeration cycle 70 with an expansion section 80, and a heavies removal zone 95. While "propane," "ethylene," and "methane" are used to refer to respective first, second, and third refrigerants, it should be understood that the embodiment illustrated in FIG. 2 and described herein can apply to any combination of suitable refrigerants. The main components of propane refrigeration cycle 30 include a propane compressor 31, a propane cooler 32, a high-stage propane chiller 33, an intermediate-stage propane chiller 34, and a low-stage propane chiller 35. The main components of ethylene refrigeration cycle 50 include an ethylene compressor 51, an ethylene cooler 52, a high-stage ethylene chiller 53, an optional first low-stage ethylene chiller 54, a second low-stage ethylene chiller/condenser 55, and an ethylene economizer 56. The main components of methane refrigeration cycle 70 include a methane compressor 71, a methane cooler 72, a main methane economizer 73, a secondary methane economizer 74, and a refrigerant accumulator 402. The main components of expansion section 80 include a high-stage methane expander 81, a high-stage methane flash drum 82, an intermediate-stage methane expander 83, an intermediate-stage methane flash drum 84, a low-stage methane expander 85, and a low-stage methane flash drum 86.

The LNG facility of FIG. 2 includes heavies removal zone located downstream of optional first low-stage ethylene chiller 54 for removing heavy hydrocarbon components from the processed natural gas and recovering the resulting natural gas liquids. The heavies removal zone 95 of FIG. 2 is shown as generally comprising a first distillation column 96 and a second distillation column 97.

The operation of the LNG facility illustrated in FIG. 2 will now be described in more detail, beginning with propane refrigeration cycle 30. Propane is compressed in multistage (e.g., three-stage) propane compressor 31 driven by, for example, a gas turbine driver (not illustrated). The three stages of compression preferably exist in a single unit, although each stage of compression may be a separate unit and the units mechanically coupled to be driven by a single driver. Upon compression, the propane is passed through conduit 300 to propane cooler 32, wherein it is cooled and liquefied via indirect heat exchange with an external fluid (e.g., air or water). A representative temperature and pressure of the liquefied propane refrigerant exiting cooler 32 is about 38° C. (100.4° F.) and about 1,310 kPa (190 psi). The stream from propane cooler 32 can then be passed through conduit 302 to a pressure reduction means, illustrated as expansion valve 36, wherein the pressure of the liquefied propane is reduced, thereby evaporating or flashing a portion thereof. The resulting two-phase stream then flows via conduit 304 into high-stage propane chiller 33. High stage propane chiller 33 uses indirect heat exchange means 37, 38, and 39 to cool respectively, the incoming gas streams, including a yet-to-be-discussed methane refrigerant stream in conduit 112, a natural gas feed stream in conduit 110, and a yet-to-be-discussed ethylene refrigerant stream in conduit 202 via indirect heat exchange with the vaporizing refrigerant. The cooled methane refrigerant stream exits high-stage propane chiller 33 via conduit 130 and can subsequently be routed to the inlet of main methane economizer 73, which will be discussed in greater detail in a subsequent section.

The cooled natural gas stream from high-stage propane chiller 33 (also referred to herein as the "methane-rich stream") flows via conduit 114 to a separation vessel 40, wherein the gaseous and liquid phases are separated. The liquid phase, which can be rich in propane and heavier components ($C_3$+), is removed via conduit 303. The predominately vapor phase exits separator 40 via conduit 116 and can then enter intermediate-stage propane chiller 34, wherein the stream is cooled in indirect heat exchange means 41 via indirect heat exchange with a yet-to-be-discussed propane refrigerant stream. The resulting two-phase methane-rich stream in conduit 118 can then be routed to low-stage propane chiller 35, wherein the stream can be further cooled via indirect heat exchange means 42. The resultant predominantly methane stream can then exit low-stage propane chiller 34 via conduit 120. Subsequently, the cooled methane-rich stream in conduit 120 can be routed to high-stage ethylene chiller 53, which will be discussed in more detail shortly.

The vaporized propane refrigerant can be withdrawn from high-stage propane chiller 33 via conduit 306 and can then be introduced into the high-stage suction port of propane compressor 31. The residual liquid propane refrigerant in high-stage propane chiller 33 can be passed via conduit 308 through a pressure reduction means, illustrated here as expansion valve 43, whereupon a portion of the liquefied refrigerant is flashed or vaporized. The resulting cooled two-phase refrigerant stream can then enter intermediate-stage propane chiller 34 via conduit 310, thereby providing coolant for the natural gas stream and yet-to-be-discussed ethylene refrigerant stream entering intermediate-stage propane chiller 34. The vaporized propane refrigerant exits intermediate-stage propane chiller 34 via conduit 312 and can then enter the intermediate-stage inlet port of propane compressor 31. The remaining liquefied propane refrigerant exits intermediate-stage propane chiller 34 via conduit 314 and is passed through a pressure-reduction means, illustrated here as expansion valve 44, whereupon the pressure of the stream is reduced to thereby flash or vaporize a portion thereof. The resulting vapor-liquid refrigerant stream then enters low-stage propane chiller 35 via conduit 316 and cools the methane-rich and yet-to-be-discussed ethylene refrigerant streams entering low-stage propane chiller 35 via conduits 118 and 206, respectively. The vaporized propane refrigerant stream then exits low-stage propane chiller 35 and is routed to the low-stage inlet port of propane compressor 31 via conduit 318 wherein it is compressed and recycled as previously described.

As shown in FIG. 2, a stream of ethylene refrigerant in conduit 202 enters high-stage propane chiller, wherein the ethylene stream is cooled via indirect heat exchange means 39. The resulting cooled stream in conduit 204 then exits high-stage propane chiller 33, whereafter the stream enters intermediate-stage propane chiller 34. Upon entering intermediate-stage propane chiller 34, the ethylene refrigerant stream can be further cooled via indirect heat exchange means 45. The resulting cooled ethylene stream can then exit intermediate-stage propane chiller 34 prior to entering low-stage propane chiller 35 via conduit 206. In low-stage propane chiller 35, the ethylene refrigerant stream can be at least partially condensed, or condensed in its entirety, via indirect heat exchange means 46. The resulting stream exits low-stage propane chiller 35 via conduit 208 and can subsequently be routed to a accumulator 47, as shown in FIG. 2. The liquefied ethylene refrigerant stream exiting accumulator 47 via conduit 212 can have a representative temperature and pressure of about −30° C. (−22° F.) and about 2,032 kPa (295 psia).

Turning now to ethylene refrigeration cycle 50 in FIG. 2, the liquefied ethylene refrigerant stream in conduit 212 can enter ethylene economizer 56, wherein the stream can be further cooled by an indirect heat exchange means 57. The sub-cooled liquid ethylene stream in conduit 214 can then be routed through a pressure reduction means, illustrated here as expansion valve 58, whereupon the pressure of the stream is reduced to thereby flash or vaporize a portion thereof. The cooled, two-phase stream in conduit 215 can then enter high-stage ethylene chiller 53, wherein at least a portion of the ethylene refrigerant stream can vaporize to thereby cool the methane-rich stream entering an indirect heat exchange means 59 of high-stage ethylene chiller 53 via conduit 120. The vaporized and remaining liquefied refrigerant exit high-stage ethylene chiller 53 via respective conduits 216 and 220. The vaporized ethylene refrigerant in conduit 216 can re-enter ethylene economizer 56, wherein the stream can be warmed via an indirect heat exchange means 60 prior to entering the high-stage inlet port of ethylene compressor 51 via conduit 218, as shown in FIG. 2.

The remaining liquefied refrigerant in conduit 220 can re-enter ethylene economizer 56, wherein the stream can be further sub-cooled by an indirect heat exchange means 61. The resulting cooled refrigerant stream exits ethylene economizer 56 via conduit 222 and can subsequently be routed to a pressure reduction means, illustrated here as expansion valve 62, whereupon the pressure of the stream is reduced to thereby vaporize or flash a portion thereof. The resulting, cooled two-phase stream in conduit 224 enters optional first low-stage ethylene chiller 54, wherein the refrigerant stream can cool the natural gas stream in conduit 122 entering optional first low-stage ethylene chiller 54 via an indirect heat exchange means 63. As shown in FIG. 2, the resulting cooled methane-rich stream exiting intermediate stage ethylene chiller 54 can then be routed to heavies removal zone 95 via conduit 124. Heavies removal zone 95 will be discussed in detail in a subsequent section.

The vaporized ethylene refrigerant exits optional first low-stage ethylene chiller 54 via conduit 226, whereafter the stream can combine with a yet-to-be-discussed ethylene vapor stream in conduit 238. The combined stream in conduit 240 can enter ethylene economizer 56, wherein the stream is warmed in an indirect heat exchange means 64 prior to being fed into the low-stage inlet port of ethylene compressor 51 via conduit 230. As shown in FIG. 2, a stream of compressed ethylene refrigerant in conduit 236 can subsequently be routed to ethylene cooler 52, wherein the ethylene stream can be cooled via indirect heat exchange with an external fluid (e.g., water or air). The resulting, at least partially condensed ethylene stream can then be introduced via conduit 202 into high-stage propane chiller 33 for additional cooling as previously described.

The remaining liquefied ethylene refrigerant exits optional first low-stage ethylene chiller 54 via conduit 228 prior to entering second low-stage ethylene chiller/condenser 55, wherein the refrigerant can cool the methane-rich stream exiting heavies removal zone 95 via conduit 126 via indirect heat exchange means 65 in second low-stage ethylene chiller/condenser 55. As shown in FIG. 2, the vaporized ethylene refrigerant can then exit second low-stage ethylene chiller/condenser 55 via conduit 238 prior to combining with the vaporized ethylene exiting optional first low-stage ethylene chiller 54 and entering the low-stage inlet port of ethylene compressor 51, as previously discussed.

The cooled natural gas stream exiting low-stage ethylene chiller/condenser can also be referred to as the "pressurized LNG-bearing stream." According to one embodiment depicted in FIG. 2, the pressurized LNG-bearing stream in conduit 132 can subsequently be routed to the fluid inlet of refrigerant accumulator 402, wherein the stream can be separated into a predominantly liquid fraction and a predominantly vapor fraction. As shown in FIG. 2, the predominantly vapor fraction can be routed to a fuel gas system (not shown), while the predominantly liquid fraction withdrawn from the bottom section of refrigerant accumulator 402 can be routed to the inlet of main methane economizer 73 via conduit 133.

In main methane economizer 73, the methane-rich stream can be cooled in an indirect heat exchange means 75 via indirect heat exchange with one or more yet-to-be discussed methane refrigerant streams. The cooled, pressurized LNG-bearing stream exits main methane economizer 73 and can then be routed via conduit 134 into expansion section 80 of methane refrigeration cycle 70. In expansion section 80, the cooled predominantly methane stream passes through high-stage methane expander 81, whereupon the pressure of the stream is reduced to thereby vaporize or flash a portion thereof. The resulting two-phase methane-rich stream in conduit 136 can then enter high-stage methane flash drum 82, whereupon the vapor and liquid portions can be separated. The vapor portion exiting high-stage methane flash drum 82 (i.e., the high-stage flash gas) via conduit 143 can then enter main methane economizer 73, wherein the stream is heated via indirect heat exchange means 76. The resulting warmed vapor stream exits main methane economizer 73 via conduit 138 and subsequently combines with a yet-to-be-discussed vapor stream exiting heavies removal zone 95 in conduit 140. The combined stream in conduit 141 can then be routed to the high-stage inlet port of methane compressor 71, as shown in FIG. 2.

The liquid phase exiting high-stage methane flash drum 82 via conduit 142 can enter secondary methane economizer 74, wherein the methane stream can be cooled via indirect heat exchange means 92. The resulting cooled stream in conduit 144 can then be routed to a second expansion stage, illustrated here as intermediate-stage expander 83. Intermediate-stage expander 83 reduces the pressure of the methane stream passing therethrough to thereby reduce the stream's temperature by vaporizing or flashing a portion thereof. The resulting two-phase methane-rich stream in conduit 146 can then enter intermediate-stage methane flash drum 84, wherein the liquid and vapor portions of the stream can be separated and can exit the intermediate-stage flash drum via respective conduits 148 and 150. The vapor portion (i.e., the intermediate-stage flash gas) in conduit 150 can re-enter secondary methane economizer 74, wherein the stream can be heated via an indirect heat exchange means 87. The warmed stream can then be routed via conduit 152 to main methane economizer 73, wherein the stream can be further warmed via an indirect heat exchange means 77 prior to entering the intermediate-stage inlet port of methane compressor 71 via conduit 154.

The liquid stream exiting intermediate-stage methane flash drum 84 via conduit 148 can then pass through a low-stage expander 85, whereupon the pressure of the liquefied methane-rich stream can be further reduced to thereby vaporize or flash a portion thereof. The resulting cooled, two-phase stream in conduit 156 can then enter low-stage methane flash drum 86, wherein the vapor and liquid phases can be separated. The liquid stream exiting low-stage methane flash drum 86 can comprise the liquefied natural gas (LNG) product. The LNG product, which is at about atmospheric pressure, can be routed via conduit 158 downstream for subsequent storage, transportation, and/or use.

The vapor stream exiting low-stage methane flash drum (i.e., the low-stage methane flash gas) in conduit 160 can be routed to secondary methane economizer 74, wherein the stream can be warmed via an indirect heat exchange means 89. The resulting stream can exit secondary methane economizer 74 via conduit 162, whereafter the stream can be routed to main methane economizer 73 to be further heated via indirect heat exchange means 78. The warmed methane vapor stream can then exit main methane economizer 73 via conduit 164 prior to being routed to the low-stage inlet port of methane compressor 71.

Generally, methane compressor 71 can comprise one or more compression stages. In one embodiment, methane compressor 71 comprises three compression stages in a single module. In another embodiment, the compression modules can be separate, but can be mechanically coupled to a common driver. Generally, when methane compressor 71 comprises two or more compression stages, one or more intercoolers (not shown) can be provided between subsequent compression stages. As shown in FIG. 2, the compressed methane refrigerant stream exiting methane compressor 71 can be discharged into conduit 166, whereafter the stream can be cooled via indirect heat exchange with an external fluid (e.g., air or water) in methane cooler 72. The cooled methane refrigerant stream exiting methane cooler 72 can then enter conduit 112, whereafter the methane refrigerant stream can be further cooled in propane refrigeration cycle 30, as described in detail previously.

Upon being cooled in propane refrigeration cycle 30, the methane refrigerant stream can be discharged into conduit 130 and subsequently routed to main methane economizer 73, wherein the stream can be further cooled via indirect heat exchange means 79. The resulting sub-cooled stream exits main methane economizer 73 via conduit 168 and can then combined with the heavies-depleted stream exiting heavies removal zone 95 via conduit 126, as previously discussed.

Turning now to heavies removal zone 95, at least a portion of the predominantly methane stream withdrawn from optional first low-stage ethylene chiller 54 via conduit 124 can subsequently be introduced into first distillation column 96. As shown in FIG. 2, at least a portion of a predominantly vapor overhead stream withdrawn from first distillation column 96 can subsequently be routed to second low-stage ethylene chiller condenser 55, wherein the stream can be further cooled via indirect heat exchange means 65, as discussed in detail previously. A predominantly liquid, heavies-rich bottoms stream withdrawn from first distillation column 96 via conduit 170 can then be introduced into second distillation column 97. The predominantly liquid bottoms stream exiting second distillation column 97 via conduit 171, which generally comprises NGL, can be routed out of heavies removal zone 95 for subsequent storage, processing, and/or future use. The predominantly vapor overhead stream withdrawn from second distillation column 97 can be routed via conduit 140 to one or more locations within the LNG facility. In one embodiment, the stream can be introduced into the high-stage suction port of methane compressor 71. In another embodiment, the stream can be routed to storage or subjected to further processing and/or use.

According to one embodiment illustrated in FIG. 2, refrigerant accumulator 402 can further comprise a control system configured to allow refrigerant accumulator 402 to operate at a different overhead pressure than heavies removal column 96. In general, the control system can comprise a level transmitter 404, a level control valve 406, a pressure transmitter 408, and a pressure control valve 410. In general, the level transmitter and control valve 404, 406 and/or pressure transmitter and control valve 408, 410 can be operable to control the flow rate of predominantly liquid and/or predominantly vapor product streams withdrawn from refrigerant accumulator 402. As illustrated in FIG. 2, in one embodiment, level transmitter and control valve 404, 406 can be used to control the flow rate of the predominantly vapor product stream, while pressure transmitter and control valve 408, 410 can be used to control the flow rate of the predominantly liquid product stream exiting refrigerant accumulator 402. In another embodiment (not shown), the level and pressure transmitters 404, 408 may be reversed.

Turning now to FIG. 3, a cascade-type LNG facility configured according to another embodiment of the present invention is illustrated. The LNG facility configured according to the embodiment illustrated in FIG. 3 is similar to the LNG facility configured according to the embodiment illustrated in FIG. 2, with like numerals designating like components. The operation of the LNG facility depicted in FIG. 3, as it differs from the LNG facility previously described with respect to FIG. 2, will now be described in detail.

As shown in FIG. 3, the pressurized, LNG-bearing stream exiting second low-stage ethylene chiller/condenser 55 in conduit 132 can be introduced into methane economizer, wherein the stream can be cooled in an indirect heat exchange means 75 via indirect heat exchange with one or more yet-to-be discussed methane refrigerant streams. The cooled, pressurized LNG-bearing stream can then exit main methane economizer 73 via conduit 134 and can thereafter pass through high-stage expander 81, thereby vaporizing or flashing a portion thereof, and the resulting two-phase stream can be introduced into high-stage flash vessel 82, as shown in FIG. 3.

As illustrated in FIG. 3, the stream of compressed refrigerant discharged from methane compressor 71 in conduit 166 can be subsequently cooled via indirect heat exchange with an external fluid (e.g., water or air) in methane cooler 72. The resulting cooled stream can subsequently be cooled in indirect heat exchange means of high-stage propane chiller 33 before re-entering methane economizer 73, wherein the stream can be further cooled via indirect heat exchange means 79. The stream exiting methane economizer 73 via conduit 168 can thereafter be routed to first optional low-stage ethylene chiller 54, wherein the stream can be cooled again via indirect heat exchange means 69. As shown in FIG. 3, the resulting stream in conduit 180 can be routed to the fluid inlet of refrigerant accumulator 402, wherein the stream can be separated into a predominantly vapor fraction in conduit 182, which can subsequently be routed to a fuel gas system (not shown) and a predominantly liquid fraction in conduit 184, which can subsequently be routed to high-stage flash drum 82.

In one embodiment illustrated in FIG. 3, the LNG facility illustrated in FIG. 3 can include one or more control devices similar to those previously discussed with respect to FIG. 2. According to one embodiment depicted in FIG. 3, the LNG facility can comprise level transmitter 404, level control valve 406, pressure transmitter 408, and pressure control valve 410 that operate in an analogous manner to similar components previously described with respect to FIG. 2. In addition, the LNG facility can comprise a second pressure transmitter 412 and a second pressure control valve 414 operable to control the flow rate of the fluid stream passing through indirect heat exchange means 75 of methane economizer 73, as illustrated in FIG. 3.

In one embodiment of the present invention, the LNG production systems illustrated in FIGS. 1-3 can be simulated on a computer using conventional process simulation software in order to generate process simulation data in a human-readable form. In one embodiment, the process simulation data can be in the form of a computer print out. In another embodiment, the process simulation data can be displayed on a screen, a monitor, or other viewing device. The simulation data can then be used to manipulate the LNG system. In one embodiment, the simulation results can be used to design a new LNG facility and/or revamp or expand an existing facility. In another embodiment, the simulation results can be used to optimize the LNG facility according to one or more operating parameters. Examples of suitable software for producing the simulation results include HYSYS™ or Aspen Plus® from Aspen Technology, Inc., and PRO/II® from Simulation Sciences Inc.

Numerical Ranges

The present description uses numerical ranges to quantify certain parameters relating to the invention. It should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

DEFINITIONS

As used herein, the terms "a," "an," "the," and "said" mean one or more.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the term "cascade-type refrigeration process" refers to a refrigeration process that employs a plurality of refrigeration cycles, each employing a different pure component refrigerant to successively cool natural gas.

As used herein, the term "closed-loop refrigeration cycle" refers to a refrigeration cycle wherein substantially no refrigerant enters or exits the cycle during normal operation.

As used herein, the terms "comprising," "comprises," and "comprise" are open-ended transition terms used to transition from a subject recited before the term to one or elements recited after the term, where the element or elements listed after the transition term are not necessarily the only elements that make up of the subject.

As used herein, the terms "containing," "contains," and "contain" have the same open-ended meaning as "comprising," "comprises," and "comprise," provided above.

As used herein, the terms "economizer" or "economizing heat exchanger" refer to a configuration utilizing a plurality of heat exchangers employing indirect heat exchange means to efficiently transfer heat between process streams.

As used herein, the term "fluid flow communication" between two components means that at least a portion of the fluid or material from the first component enters, passes through, or otherwise comes into contact with the second component.

As used herein, the terms "having," "has," and "have" have the same open-ended meaning as "comprising," "comprises," and "comprise," provided above.

As used herein, the terms "heavy hydrocarbon" and "heavies" refer to any component that is less volatile (i.e., has a higher boiling point) than methane.

As used herein, the terms "including," "includes," and "include" have the same open-ended meaning as "comprising," "comprises," and "comprise," provided above.

As used herein, the term "incondensables" refers to components having a vapor pressure higher than the vapor pressure of methane at standard conditions of 60° F. and 1 atmosphere.

As used herein, the term "major portion" refers to at least 50 mole percent of a given amount of material. For example, a second process stream comprising a major portion of a first process stream comprises at least 50 mole percent of the total first process stream.

As used herein, the term "mid-range standard boiling point" refers to the temperature at which half of the weight of a mixture of physical components has been vaporized (i.e., boiled off) at standard pressure.

As used herein, the term "mixed refrigerant" refers to a refrigerant containing a plurality of different components, where no single component makes up more than 65 mole percent of the refrigerant.

As used herein, the term "natural gas" means a stream containing at least 60 mole percent methane, with the balance being inerts, ethane, higher hydrocarbons, nitrogen, carbon dioxide, and/or a minor amount of other contaminants such as mercury, hydrogen sulfide, and mercaptan.

As used herein, the terms "natural gas liquids" or "NGL" refer to mixtures of hydrocarbons whose components are, for example, typically heavier than methane. Some examples of hydrocarbon components of NGL streams include ethane, propane, butane, and pentane isomers, benzene, toluene, and other aromatic compounds.

As used herein, the term "open-loop refrigeration cycle" refers to a refrigeration cycle wherein at least a portion of the refrigerant employed during normal operation originates from the fluid being cooled by the refrigerant cycle.

As used herein, the terms "predominantly," "primarily," "principally," and "in major portion," when used to describe the presence of a particular component of a fluid stream, means that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

As used herein, the term "pure component refrigerant" means a refrigerant that is not a mixed refrigerant.

As used herein, the terms "upstream" and "downstream" refer to the relative positions of various components of a natural gas liquefaction facility along a fluid flow path in an LNG facility. For example, a component A is located downstream of another component B if component A is positioned along a fluid flow path that has already passed through component B. Likewise, component A is located upstream of component B if component A is located on a fluid flow path that has not yet passed through component B.

Claims not Limited to Disclosed Embodiments

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A process for liquefying a natural gas stream, the process comprising:

(a) cooling said natural gas stream via indirect heat exchange with a first refrigerant in a first closed-loop refrigeration cycle to provide a cooled natural gas stream;

(b) further cooling at least a portion of the cooled natural gas stream via indirect heat exchange with a predominantly methane refrigerant in an open-loop refrigeration cycle to provide a further cooled natural gas stream, wherein the open-loop refrigeration cycle comprises a refrigerant compressor;

(c) separating an incondensable material from at least a portion of the further cooled natural gas stream in a first separation vessel to provide an incondensables-depleted predominantly liquid bottoms fraction and an incondensables-rich predominantly vapor overhead fraction, wherein at least a portion of said further cooled natural gas stream introduced into said first separation vessel has passed through said refrigerant compressor;

(d) routing the incondensables-rich predominantly vapor overhead fraction to a fuel gas system for use as a fuel gas; and (e) recovering the incondensables-depleted predominantly liquid bottoms fraction back into the predominantly methane refrigerant of the open-loop refrigeration cycle, wherein the incondensables-depleted predominantly liquid bottoms fraction is controllably routed from the first separation vessel routed directly to an inlet of a main heat exchanger of the open-loop refrigeration cycle along a first path and from the first separation vessel to an outlet of the main heat exchanger of the open-loop refrigeration cycle along a bypass path.

2. The process of claim 1, further comprising, prior to step (b), separating at least a portion of said cooled natural gas stream into a heavies-depleted stream and a heavies-rich stream in a heavies removal column, wherein said at least a portion of said cooled natural gas stream introduced into said open-loop refrigeration cycle comprises at least a portion of said heavies-depleted stream.

3. The process of claim 2, wherein the overhead pressure of said first separation vessel is at least about 170 kPa greater than the overhead pressure of said heavies removal column.

4. The process of claim 2, further comprising, prior to step (b), cooling at least a portion of said heavies-depleted stream in a second refrigeration cycle via indirect heat exchange with a second refrigerant to thereby provide a cooled heavies-depleted stream, wherein said at least a portion of cooled natural gas stream introduced into said open-loop refrigeration cycle comprises at least a portion of said cooled heavies-depleted stream.

5. The process of claim 1, wherein the further cooled natural gas stream introduced into said first separation vessel has a temperature in the range of from about −80° C. to about −105° C. and a pressure in the range of from about 3,790 kPa to about 4,485 kPa.

6. The process of claim 1, further comprising, subsequent to step (b), flashing at least a portion of said further cooled natural gas stream to thereby provide a two-phase natural gas stream and separating at least a portion of said two-phase natural gas stream into a cooled vapor fraction and a cooled liquid fraction, wherein the further cooled natural gas stream introduced into said first separation vessel comprises at least a portion of said cooled vapor fraction.

7. The process of claim 6, wherein said predominantly methane refrigerant comprises at least a portion of said cooled vapor fraction.

8. The process of claim 6, further comprising compressing at least a portion of said cooled vapor fraction in said refrigerant compressor, wherein substantially all of the further cooled natural gas stream introduced into said first separation vessel has passed through said compressor.

9. The process of claim 1, wherein said first refrigerant is a pure component refrigerant.

10. The process of claim 1, wherein said first refrigerant predominantly comprises propane, propylene, ethane, or ethylene.

11. The process of claim 1, further comprising measuring the pressure of said predominantly vapor stream and/or said predominantly liquid stream withdrawn from said first separation vessel to provide a measured pressure value and, based on said measured pressure value, adjusting the flow rate of said predominantly vapor stream and/or said predominantly liquid stream.

12. The process of claim 1, wherein said first separation vessel defines an operating liquid level; further comprising, measuring said operating liquid level of said first separation vessel to provide a measured level value and, based on said measured level value, adjusting the flow rate of said predominantly vapor stream and/or said predominantly liquid stream withdrawn from said first separation vessel.

13. The process of claim 1, wherein said first separation vessel is horizontally elongated.

* * * * *